US008555958B2

(12) United States Patent
Amaral et al.

(10) Patent No.: US 8,555,958 B2
(45) Date of Patent: Oct. 15, 2013

(54) PIPELESS STEAM ASSISTED GRAVITY DRAINAGE SYSTEM AND METHOD

(75) Inventors: Anderson da Silva Amaral, Spring, TX (US); Bradley Gene Baker, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 737 days.

(21) Appl. No.: 12/142,417

(22) Filed: Jun. 19, 2008

(65) Prior Publication Data

US 2009/0283272 A1 Nov. 19, 2009

Related U.S. Application Data

(60) Provisional application No. 61/052,919, filed on May 13, 2008.

(51) Int. Cl.
*E21B 43/24* (2006.01)

(52) U.S. Cl.
USPC ..... 166/115; 166/303; 166/263; 166/116

(58) Field of Classification Search
USPC ..... 166/114, 115, 116, 303, 263, 272.3
See application file for complete search history.

(56) References Cited

U.S. PATENT DOCUMENTS

| | | | |
|---|---|---|---|
| 266,848 | A | 10/1882 | Lewis |
| 1,362,552 | A | 12/1920 | Alexander et al. |
| 1,488,753 | A | 4/1924 | Kelly |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,391,609 | A | 12/1945 | Wright |
| 2,412,841 | A | 12/1946 | Spangler |
| 2,762,437 | A | 9/1956 | Egan et al. |
| 2,804,926 | A | 9/1957 | Zublin |
| 2,810,352 | A | 10/1957 | Tumlison |
| 2,814,947 | A | 12/1957 | Stegemeier et al. |

(Continued)

FOREIGN PATENT DOCUMENTS

| | | |
|---|---|---|
| CN | 1385594 | 12/2002 |
| GB | 1492345 | 6/1976 |

(Continued)

OTHER PUBLICATIONS

"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.

(Continued)

*Primary Examiner* — Kenneth L Thompson
*Assistant Examiner* — Robert E Fuller
(74) *Attorney, Agent, or Firm* — Cantor Colburn LLP

(57) ABSTRACT

A SAGD system including a string defining an axial flow channel and an annular flow pathway, a fluid access structure between the axial flow channel and the annular flow pathway, and a valve disposed within the annular flow pathway. The valve being selectively closable to selectively inhibit annular flow in an uphole direction. A method for treating a SAGD formation.

20 Claims, 8 Drawing Sheets

(56) References Cited

U.S. PATENT DOCUMENTS 2,942,668 A 6/1960 Maly et al.
2,945,541 A 7/1960 Maly et al.
3,103,789 A 9/1963 McDuff
3,240,274 A 3/1966 Solum
3,273,641 A 9/1966 Bourne
3,302,408 A 2/1967 Schmid
3,322,199 A 5/1967 Van Note, Jr.
3,326,291 A 6/1967 Zandmer
3,333,635 A 8/1967 Crawford
3,385,367 A 5/1968 Kollsman
3,386,508 A 6/1968 Bielstein et al.
3,419,089 A 12/1968 Venghiattis
3,446,297 A 5/1969 Elliott et al.
3,451,477 A 6/1969 Kelley
3,468,375 A 9/1969 States
3,520,367 A * 7/1970 Needham et al. ..... 166/302
3,612,176 A 10/1971 Bauer et al.
RE27,252 E 12/1971 Sklar et al.
3,675,714 A 7/1972 Thompson
3,692,064 A 9/1972 Hohnerlein et al.
3,739,845 A 6/1973 Berry et al.
3,791,444 A 2/1974 Hickey
3,876,235 A 4/1975 Flint
3,876,471 A 4/1975 Jones
3,918,523 A 11/1975 Stuber
3,951,338 A 4/1976 Genna
3,958,649 A 5/1976 Bull et al.
3,975,651 A 8/1976 Griffiths
3,987,854 A * 10/1976 Callihan et al. ..... 166/278
4,153,757 A 5/1979 Clark, III
4,173,255 A 11/1979 Kramer
4,180,132 A 12/1979 Young
4,186,100 A 1/1980 Mott
4,187,909 A 2/1980 Erbstoesser
4,245,701 A 1/1981 Chambers
4,248,302 A 2/1981 Churchman
4,250,907 A 2/1981 Struckman et al.
4,257,650 A 3/1981 Allen
4,265,485 A 5/1981 Boxerman et al.
4,278,277 A 7/1981 Krijgsman
4,283,088 A 8/1981 Tabakov et al.
4,287,952 A 9/1981 Erbstoesser
4,332,401 A 6/1982 Stephenson et al.
4,390,067 A 6/1983 Willman
4,398,898 A 8/1983 Odom
4,410,216 A 10/1983 Allen
4,415,205 A 11/1983 Rehm et al.
4,434,849 A 3/1984 Allen
4,463,988 A 8/1984 Bouck et al.
4,484,641 A 11/1984 Dismukes
4,491,186 A 1/1985 Alder
4,497,714 A 2/1985 Harris
4,512,403 A 4/1985 Santangelo et al.
4,552,218 A 11/1985 Ross et al.
4,552,230 A 11/1985 Anderson et al.
4,572,295 A 2/1986 Walley
4,576,404 A 3/1986 Weber
4,577,691 A 3/1986 Huang et al.
4,614,303 A 9/1986 Moseley, Jr. et al.
4,649,996 A 3/1987 Kojicic et al.
4,817,710 A 4/1989 Edwards et al.
4,821,800 A 4/1989 Scott et al.
4,856,590 A 8/1989 Caillier
4,899,835 A 2/1990 Cherrington
4,917,183 A 4/1990 Gaidry et al.
4,944,349 A 7/1990 Von Gonten, Jr.
4,974,674 A 12/1990 Wells
4,997,037 A 3/1991 Coston
4,998,585 A 3/1991 Newcomer et al.
5,004,049 A 4/1991 Arterbury
5,016,710 A 5/1991 Renard et al.
5,040,283 A 8/1991 Pelgrom
5,060,737 A 10/1991 Mohn
5,107,927 A 4/1992 Whiteley et al.
5,132,903 A 7/1992 Sinclair
5,156,811 A 10/1992 White
5,188,191 A 2/1993 Tomek
5,217,076 A 6/1993 Masek
5,333,684 A 8/1994 Walter et al.
5,337,821 A 8/1994 Peterson
5,339,895 A 8/1994 Arterbury et al.
5,339,897 A 8/1994 Leaute
5,355,956 A 10/1994 Restarick
5,377,750 A 1/1995 Arterbury et al.
5,381,864 A 1/1995 Nguyen et al.
5,384,046 A 1/1995 Lotter et al.
5,431,346 A 7/1995 Sinaisky
5,435,393 A 7/1995 Brekke et al.
5,435,395 A 7/1995 Connell
5,439,966 A 8/1995 Graham et al.
5,511,616 A 4/1996 Bert
5,551,513 A 9/1996 Surles et al.
5,579,844 A * 12/1996 Rebardi et al. ..... 166/296
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols et al.
5,829,520 A 11/1998 Johnson
5,831,156 A 11/1998 Mullins
5,839,508 A 11/1998 Tubel et al.
5,873,410 A 2/1999 Iato et al.
5,881,809 A 3/1999 Gillespie et al.
5,896,928 A 4/1999 Coon
5,944,446 A 8/1999 Hocking
5,982,801 A 11/1999 Deak
6,044,869 A 4/2000 Koob
6,068,015 A 5/2000 Pringle
6,098,020 A 8/2000 Den Boer
6,112,815 A 9/2000 Bøe et al.
6,112,817 A 9/2000 Voll et al.
6,119,780 A 9/2000 Christmas
6,158,510 A * 12/2000 Bacon et al. ..... 166/272.7
6,182,755 B1 2/2001 Mansure
6,228,812 B1 5/2001 Dawson et al.
6,253,847 B1 7/2001 Stephenson
6,253,861 B1 7/2001 Carmichael et al.
6,273,194 B1 8/2001 Hiron et al.
6,301,959 B1 10/2001 Hrametz et al.
6,305,470 B1 10/2001 Woie
6,325,152 B1 12/2001 Kelley et al.
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnarson et al.
6,530,431 B1 3/2003 Castano-Mears et al.
6,561,732 B1 5/2003 Bloomfield et al.
6,581,681 B1 6/2003 Zimmerman et al.
6,581,682 B1 6/2003 Parent et al.
6,622,794 B2 9/2003 Zisk, Jr.
6,632,527 B1 10/2003 McDaniel et al.
6,635,732 B2 10/2003 Mentak
6,667,029 B2 12/2003 Zhong et al.
6,679,324 B2 1/2004 Den Boer et al.
6,692,766 B1 2/2004 Rubinstein et al.
6,699,503 B1 3/2004 Sako et al.
6,699,611 B2 3/2004 Kim et al.
6,712,154 B2 3/2004 Cook et al.
6,722,437 B2 4/2004 Vercaemer et al.
6,786,285 B2 9/2004 Johnson et al.
6,817,416 B2 11/2004 Wilson et al.
6,820,690 B2 11/2004 Vercaemer et al.
6,830,104 B2 12/2004 Nguyen et al.
6,831,044 B2 12/2004 Constien
6,840,321 B2 1/2005 Restarick et al.
6,857,476 B2 2/2005 Richards
6,863,126 B2 3/2005 McGlothen et al.
6,896,049 B2 5/2005 Moyes
6,913,079 B2 7/2005 Tubel
6,938,698 B2 9/2005 Coronado

(56) References Cited

U.S. PATENT DOCUMENTS

| | | | | |
|---|---|---|---|---|
| 6,951,252 | B2 | 10/2005 | Restarick et al. | |
| 6,959,764 | B2 | 11/2005 | Preston | |
| 6,976,542 | B2 | 12/2005 | Henriksen et al. | |
| 7,011,076 | B1 | 3/2006 | Weldon et al. | |
| 7,032,675 | B2 | 4/2006 | Steele et al. | |
| 7,059,410 | B2 | 6/2006 | Bousche et al. | |
| 7,084,094 | B2 | 8/2006 | Gunn et al. | |
| 7,159,656 | B2 | 1/2007 | Eoff et al. | |
| 7,185,706 | B2 | 3/2007 | Freyer | |
| 7,207,385 | B2 | 4/2007 | Smith et al. | |
| 7,252,162 | B2 | 8/2007 | Akinlade et al. | |
| 7,258,166 | B2 | 8/2007 | Russell | |
| 7,264,047 | B2 | 9/2007 | Brezinski et al. | |
| 7,290,606 | B2 | 11/2007 | Coronado et al. | |
| 7,290,610 | B2 | 11/2007 | Corbett et al. | |
| 7,318,472 | B2 | 1/2008 | Smith | |
| 7,322,412 | B2 | 1/2008 | Badalamenti et al. | |
| 7,325,616 | B2 | 2/2008 | Lopez de Cardenas et al. | |
| 7,360,593 | B2 | 4/2008 | Constien | |
| 7,367,399 | B2 | 5/2008 | Steele et al. | |
| 7,395,858 | B2 | 7/2008 | Barbosa et al. | |
| 7,398,822 | B2 | 7/2008 | Meijer et al. | |
| 7,409,999 | B2 | 8/2008 | Henriksen et al. | |
| 7,413,022 | B2 | 8/2008 | Broome et al. | |
| 7,451,814 | B2 | 11/2008 | Graham et al. | |
| 7,469,743 | B2 | 12/2008 | Richards | |
| 7,484,566 | B2 * | 2/2009 | Tips et al. | 166/373 |
| 7,581,593 | B2 | 9/2009 | Pankratz et al. | |
| 7,621,326 | B2 | 11/2009 | Crichlow | |
| 7,644,854 | B1 | 1/2010 | Holmes et al. | |
| 7,647,966 | B2 | 1/2010 | Cavender et al. | |
| 7,673,678 | B2 | 3/2010 | MacDougall et al. | |
| 7,757,757 | B1 | 7/2010 | Vroblesky | |
| 7,913,755 | B2 * | 3/2011 | Johnson | 166/227 |
| 7,931,081 | B2 | 4/2011 | Sponchia | |
| 2002/0020527 | A1 | 2/2002 | Kilaas | |
| 2002/0125009 | A1 | 9/2002 | Wetzel et al. | |
| 2002/0148610 | A1 | 10/2002 | Bussear et al. | |
| 2002/0170717 | A1 | 11/2002 | Venning et al. | |
| 2003/0221834 | A1 | 12/2003 | Hess et al. | |
| 2004/0052689 | A1 | 3/2004 | Yao | |
| 2004/0060705 | A1 | 4/2004 | Kelley | |
| 2004/0094307 | A1 | 5/2004 | Daling et al. | |
| 2004/0144544 | A1 | 7/2004 | Freyer | |
| 2004/0159447 | A1 | 8/2004 | Bissonnette et al. | |
| 2004/0194971 | A1 | 10/2004 | Thomson | |
| 2004/0244988 | A1 | 12/2004 | Preston | |
| 2005/0016732 | A1 | 1/2005 | Brannon et al. | |
| 2005/0086807 | A1 | 4/2005 | Richard et al. | |
| 2005/0126776 | A1 | 6/2005 | Russell | |
| 2005/0178705 | A1 | 8/2005 | Broyles et al. | |
| 2005/0189119 | A1 | 9/2005 | Gynz-Rekowski | |
| 2005/0199298 | A1 | 9/2005 | Farrington | |
| 2005/0207279 | A1 | 9/2005 | Chemali et al. | |
| 2005/0241835 | A1 | 11/2005 | Burris et al. | |
| 2005/0274515 | A1 | 12/2005 | Smith et al. | |
| 2006/0032630 | A1 | 2/2006 | Heins | |
| 2006/0042798 | A1 | 3/2006 | Badalamenti et al. | |
| 2006/0048936 | A1 | 3/2006 | Fripp et al. | |
| 2006/0048942 | A1 | 3/2006 | Moen et al. | |
| 2006/0076150 | A1 | 4/2006 | Coronado et al. | |
| 2006/0086498 | A1 | 4/2006 | Wetzel et al. | |
| 2006/0108114 | A1 | 5/2006 | Johnson | |
| 2006/0118296 | A1 | 6/2006 | Dybevik et al. | |
| 2006/0124360 | A1 | 6/2006 | Lee et al. | |
| 2006/0157242 | A1 | 7/2006 | Graham et al. | |
| 2006/0175065 | A1 | 8/2006 | Ross | |
| 2006/0185849 | A1 | 8/2006 | Edwards et al. | |
| 2006/0250274 | A1 | 11/2006 | Mombourquette et al. | |
| 2006/0272814 | A1 | 12/2006 | Broome et al. | |
| 2006/0273876 | A1 | 12/2006 | Pachla et al. | |
| 2007/0012444 | A1 | 1/2007 | Horgan et al. | |
| 2007/0039741 | A1 | 2/2007 | Hailey, Jr. | |
| 2007/0044962 | A1 | 3/2007 | Tibbles | |
| 2007/0045266 | A1 | 3/2007 | Sandberg et al. | |
| 2007/0056729 | A1 | 3/2007 | Pankratz et al. | |
| 2007/0131434 | A1 | 6/2007 | MacDougall et al. | |
| 2007/0181299 | A1 | 8/2007 | Chung et al. | |
| 2007/0209799 | A1 | 9/2007 | Vinegar et al. | |
| 2007/0246210 | A1 | 10/2007 | Richards | |
| 2007/0246213 | A1 | 10/2007 | Hailey, Jr. | |
| 2007/0246225 | A1 | 10/2007 | Hailey, Jr. et al. | |
| 2007/0246407 | A1 | 10/2007 | Richards et al. | |
| 2007/0272408 | A1 | 11/2007 | Zazaovsky et al. | |
| 2007/0289749 | A1 | 12/2007 | Wood et al. | |
| 2008/0025125 | A1 | 1/2008 | Rajan et al. | |
| 2008/0035349 | A1 | 2/2008 | Richard | |
| 2008/0035350 | A1 | 2/2008 | Henriksen et al. | |
| 2008/0053662 | A1 | 3/2008 | Williamson et al. | |
| 2008/0135249 | A1 | 6/2008 | Fripp et al. | |
| 2008/0149323 | A1 | 6/2008 | O'Malley et al. | |
| 2008/0149351 | A1 | 6/2008 | Marya et al. | |
| 2008/0169099 | A1 | 7/2008 | Pensgaard | |
| 2008/0236839 | A1 | 10/2008 | Oddie | |
| 2008/0236843 | A1 | 10/2008 | Scott et al. | |
| 2008/0283238 | A1 | 11/2008 | Richards et al. | |
| 2008/0296023 | A1 | 12/2008 | Willauer | |
| 2008/0314590 | A1 | 12/2008 | Patel | |
| 2009/0056816 | A1 | 3/2009 | Arov et al. | |
| 2009/0057014 | A1 | 3/2009 | Richard et al. | |
| 2009/0071646 | A1 | 3/2009 | Pankratz et al. | |
| 2009/0101330 | A1 | 4/2009 | Johnson | |
| 2009/0101342 | A1 | 4/2009 | Gaudette et al. | |
| 2009/0133869 | A1 | 5/2009 | Clem | |
| 2009/0133874 | A1 | 5/2009 | Dale et al. | |
| 2009/0139717 | A1 | 6/2009 | Richard et al. | |
| 2009/0139727 | A1 | 6/2009 | Tanju et al. | |
| 2009/0194282 | A1 | 8/2009 | Beer et al. | |
| 2009/0205834 | A1 | 8/2009 | Garcia et al. | |
| 2009/0301704 | A1 | 12/2009 | Dillett et al. | |
| 2010/0126720 | A1 | 5/2010 | Kaiser et al. | |
| 2011/0042096 | A1 | 2/2011 | Nutley et al. | |

FOREIGN PATENT DOCUMENTS

| | | | |
|---|---|---|---|
| GB | 2341405 | | 3/2000 |
| JP | 59089383 | | 5/1984 |
| SU | 1335677 | | 8/1985 |
| WO | 9403743 | | 2/1994 |
| WO | 0079097 | | 12/2000 |
| WO | 0165063 | | 9/2001 |
| WO | 0177485 | | 10/2001 |
| WO | 0192681 | A1 | 12/2001 |
| WO | 02075110 | | 9/2002 |
| WO | 2004018833 | A1 | 3/2004 |
| WO | 2006015277 | | 2/2006 |
| WO | 2008092241 | A1 | 8/2008 |

OTHER PUBLICATIONS

"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Baker Oil Tools, Product Report, Sand Control Systems: Screens, Equalizer CF Product Family No. H48688. Nov. 2005. 1 page.

Bercegeay, E. P., et al. "A One-Trip Gravel Packing System," SPE 4771, New Orleans, Louisiana, Feb. 7-8, 1974. 12 pages.

Burkill, et al. Selective Steam Injection in Open hole Gravel-packed Liner Completions SPE 595.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, March; pp. 13-18; 1997 Society of Petroleum Engieneers.

Dikken, Ben J., SPE, Koninklijke/Shell E&P Laboratorium; "Pressure Drop in Horizontal Wells and Its Effect on Production Perfor-

(56) References Cited

OTHER PUBLICATIONS mance"; Nov. 1990, JPT; Copyright 1990, Society of Petroleum Engineers; pp. 1426-1433.
Dinarvand. R., D'Emanuele, A (1995) The use of thermoresponsive hydrogels for on-off release of molecules, J. Control. Rel. 36 221-227.
E.L. Joly, et al. New Production Logging Technique for Horizontal Wells. SPE 14463 1988.
Hackworth, et al. "Development and First Application of Bistable Expandable Sand Screen," Society of Petroleum Engineers: SPE 84265. Oct. 5-8, 2003. 14 pages.
Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.
Mathis, Stephen P. "Sand Management: A Review of Approaches and Conerns," SPE 82240, The Hague, The Netherlands, May 13-14, 2003. 7 pages.
Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29 Houston, Texas, 2004, Society of Patent Engineers.
Pardo, et al. "Completion, Techniques Used in Horizontal Wells Drilled in Shallow Gas Sands in the Gulf of Mexio". SPE 24842. Oct. 4-7, 1992.
R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.
Tanaka, T., Ricka, J., (1984) Swelling of Ionic gels: Quantitative performance of the Donnan Thory, Macromolecules, 17, 2916-2921.
Tanaka, T., Nishio, I., Sun, S.T., Uena-Nisho, S. (1982) Collapse of gels in an electric field, Science, 218-467-469.
Notification of Transmittal of the International Search Report and the Written Opinion of the International Searching Authority; PCT Application No. PCT/US2010/034747; Mailed Dec. 13, 2010; Korean Intellectualy Property Office.
International Search Report; Date of Mailing Jan. 27, 2011; International Application No. PCT/US2010/034752; 3 Pages.
International Search Report and Written Opinion; Date of Mailing Jan. 27, 2011, International Appln No. PCT/US2010/034758; International Search Report 10 Pages; Written Opinion 3 Pages.
MacKenzie, Gordon and Garfield, Garry, Baker Oil Tools, Wellbore Isolation Intervention Devices Utilizing a Metal-to-Metal Rather Than an Elastomeric Sealing Methodology, SPE 109791, Society of Petroleum Engineers, Presentation at the 2007 SPE Annual Technical Conference and Exhibition held in Anaheim, California, U.S.A., Nov. 11-14, 2007, pp. 1-5.
Baker Hughes, Thru-Tubing Intervention, Z-Seal Technology, Z-Seal Metal-to-Metal Sealing Technology Shifts the Paradigm,http://www.bakerhughes.com/assets/media/brochures/4d121c2bfa7e1c7c9c00001b/file/30574t-ttintervention_catalog-1110.pdf.pdf&fs=4460520, 2010 pp. 79-81.
International Search Report and Written Opinion; Date of Mailing Jan. 13, 2011; International Appln No. PCT/US2010/034750; International Search Report 5 Pages; Written Opinion 3 Pages.
International Search Report and Written Opinion, Mailed Feb. 2, 2010, International Appln. No. PCT/US2009/049661, Written Opinion 7 Pages, International Search Report 3 Pages.
Restarick, Henry; "Horizontal Completion Options in Reservoirs With Sand Problems"; SPE29831; SPE Middle East Oil Show, Bahrain; Mar. 11-14, 1995; pp. 545-560.
Richard, Bennett M., et al.; U.S. Appl. No. 11/949,403; "Multi-Position Valves for Fracturing and Sand Control and Associated Completion Methods", filed in the United States Patent and Trademark Office Dec. 3, 2007. Specification Having 13 Pages and Drawings Having 11 Sheets.
Concentric Annular Pack Screen (CAPS) Service; Retrieved From Internet on Jun. 18, 2008. http://www.halliburton.com/ps/Default.aspx?navid=81&pageid=273&prodid=PRN%3a%3aIQSHF J2QK.

* cited by examiner

PIPELESS STEAM ASSISTED GRAVITY DRAINAGE SYSTEM AND METHOD

CROSS REFERENCE TO RELATED APPLICATION

The present application claims priority to U.S. Provisional Patent Application Ser. No. 61/052,919, filed May 13, 2008, the entire contents of which are specifically incorporated herein by reference.

BACKGROUND

SAGD or Steam Assisted Gravity Drainage is a method for extracting liquid hydrocarbons from tar sand type deposits. Due to the bituminous condition of the hydrocarbon reserves in such deposits, flow by conventional means does not occur at all or at a rate that can support any commercial activity. Utilizing steam to heat the formation so that the hydrocarbon deposits can flow allows production of the deposits. Generally, SAGD systems utilize two or more boreholes where one or more is a producer well and one or more is an injector well. The injector wells are utilized to inject high temperature steam into the formation to heat the same and thereby reduce the viscosity of the bituminous deposit sufficiently to allow flow thereof. The production wells catch the flowing hydrocarbon and ferry it to surface for further processing.

Existing systems designed to perform the method discussed above are functional but require cooling of the wellbore if components need to be removed to surface for servicing. This is because the components are so hot from steam injection that they are difficult to handle at the rotary table. Further, many of the components are badly distorted by recovery to surface due to the high temperature at which they are pulled from the wellbore.

In view of greater demand for oil and other hydrocarbon products, more efficient means of extracting hydrocarbons from tar sand type deposits will be well received by the art.

SUMMARY

A SAGD system including a string defining an axial flow channel and an annular flow pathway, a fluid access structure between the axial flow channel and the annular flow pathway, and a valve disposed within the annular flow pathway. The valve being selectively closable to selectively inhibit annular flow in an uphole direction.

A SAGD completion including a plurality of equalizers defining a predominantly axial flow, a shroud radially outwardly adjacent the equalizers, and a selectively closeable valve positioned to selectively inhibit annular flow in an uphole direction from a point proximate an uphole extent of the plurality of equalizers.

A method for treating a SAGD formation including circulating steam along an axial flow channel of a well completion and through a fluid access structure into contact with the formation, thereby warming the formation, passing the steam through an annulus valve and selectively closing the annulus valve; and pumping steam into the formation.

BRIEF DESCRIPTION OF THE DRAWINGS

Referring now to the drawings wherein like elements are numbered alike in the several Figures.

DETAILED DESCRIPTION

Figure 1:
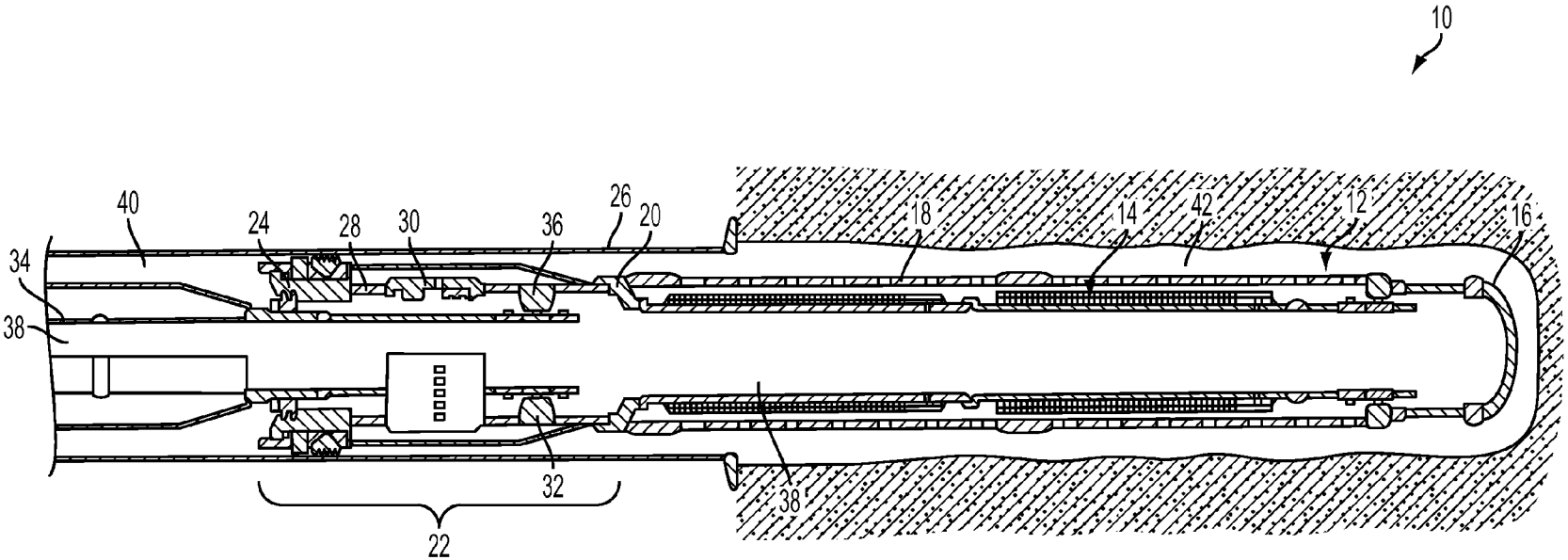
FIG. 1 is a schematic view of a Bottom Hole Assembly (BHA) in accordance with the teaching herein illustrating system components.

Referring to FIG. 1, a BHA 10 specifically suited to the SAGD environment is illustrated. The BHA 10 includes an open hole segment 12 illustrated with two fluid access structures 14 such as equalizers (such as part number H486785500, commercially available from Baker Oil Tools Houston Tex.), though it is to be understood that one or more equalizers 14 are contemplated. At a downhole end of the BHA 10 is a bull plug 16 or other cap. Disposed about the one or more equalizers 14 is an outer shroud 18. A control line connector 20, such as a PZM Quick Connect (also commercially available from Baker Oil Tools, Houston Tex.) is employed to physically connect the equalizers 14 packer and seal bore assembly 22. Assembly 22 comprises a control line feed-through packer 24 sealable to a casing wall 26. In one embodiment the packer 24 is a PZM FT packer commercially available from Baker Oil Tools under part number H488-75-9600. Extending from the packer 24 is a tubular 28 having a selectively closeable valve 30 such as an ICS Defender valve (commercially available from Baker Oil Tools) and a seal bore 32. An upper string 34, that will be described more fully later in this disclosure, is stabbed into seal bore 32 creating a fluid tight interface 36. By these components in combination a flow channel 38 is created axially of the components and an annular flow pathway 40. The annular flow pathway 40 is fluidly communicated to an annulus 24 outside of the shroud 18 through selectively closable valve 30, which is initially open.

Figure 2:
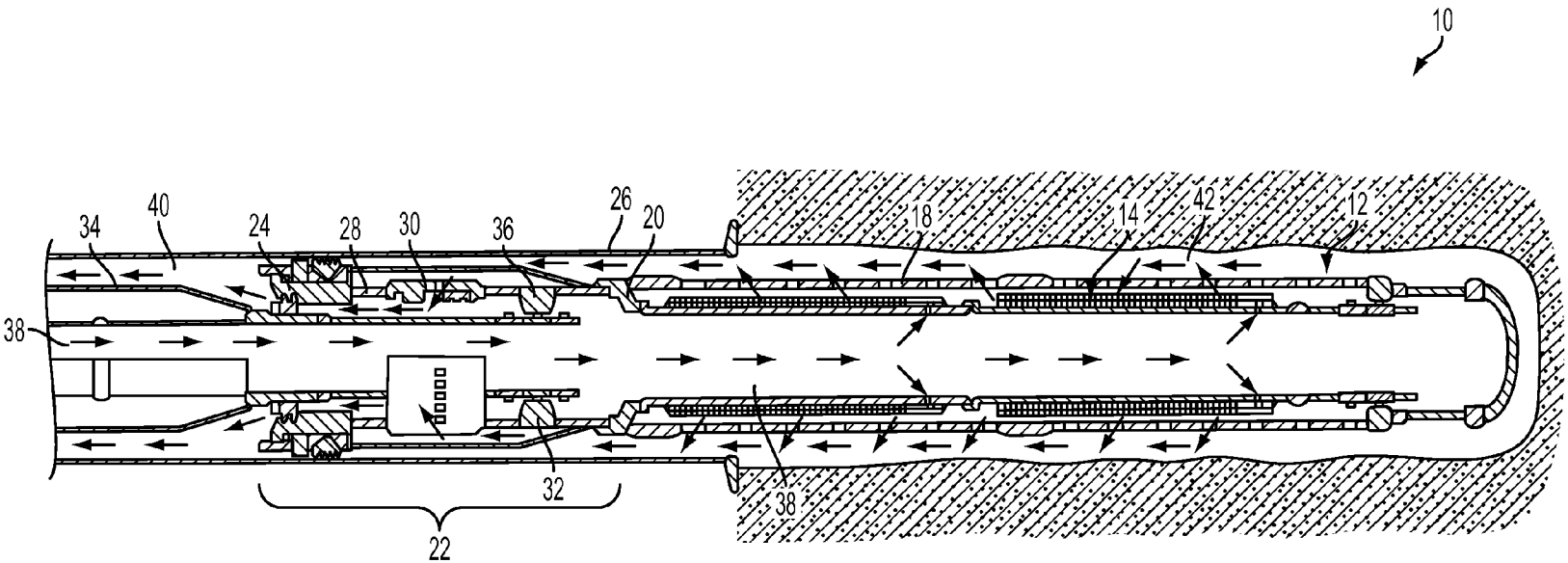
FIG. 2 is a schematic view of the system of FIG. 1 illustrating a flow direction for a warm up phase.

Referring to FIG. 2, arrows are added to the illustration of FIG. 1 that indicate the fluid flow directions in a first step of use of either an injection or production wellbore of the system. This is the "warm-up" phase where steam is caused to flow in the direction of the arrows to warm the reservoir prior to higher pressure steam injection. Steam flows through the equalizer(s) 14 to be evenly distributed through the open hole and then flows back toward annulus 40 through the selectively closable valve 30. It is also to be noted in FIG. 2, that a collapse area 42 is illustrated to show that flow is not impeded for the applied fluid because there is a pathway between the shroud 18 and the equalizer(s)14 through which the flow may continue. When sufficient steam has been delivered to the target location, as determined by sensor readings or some calculated method, the "warm-up" phase is complete and flow is reversed as illustrated in FIG. 3.

Figure 3:
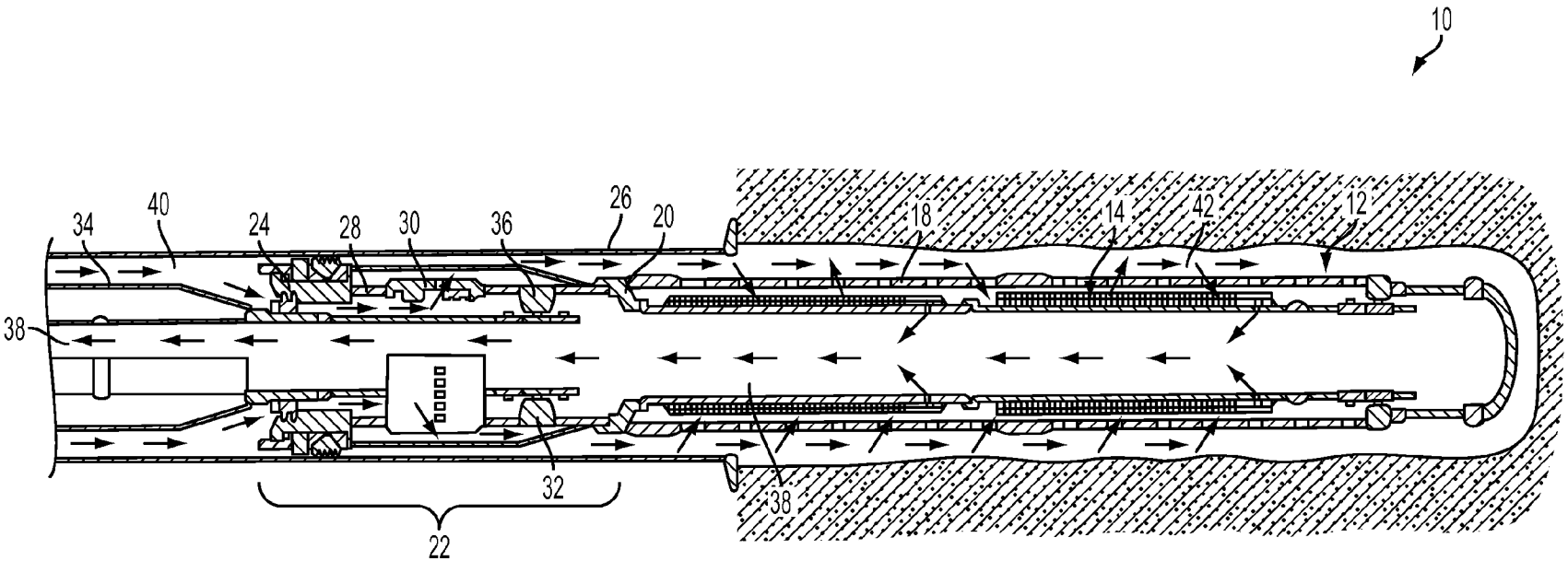
FIG. 3 is a schematic view of the system of FIG. 1 illustrating an inverted flow regime to return fluids to surface through the production pipe.
Figure 4:
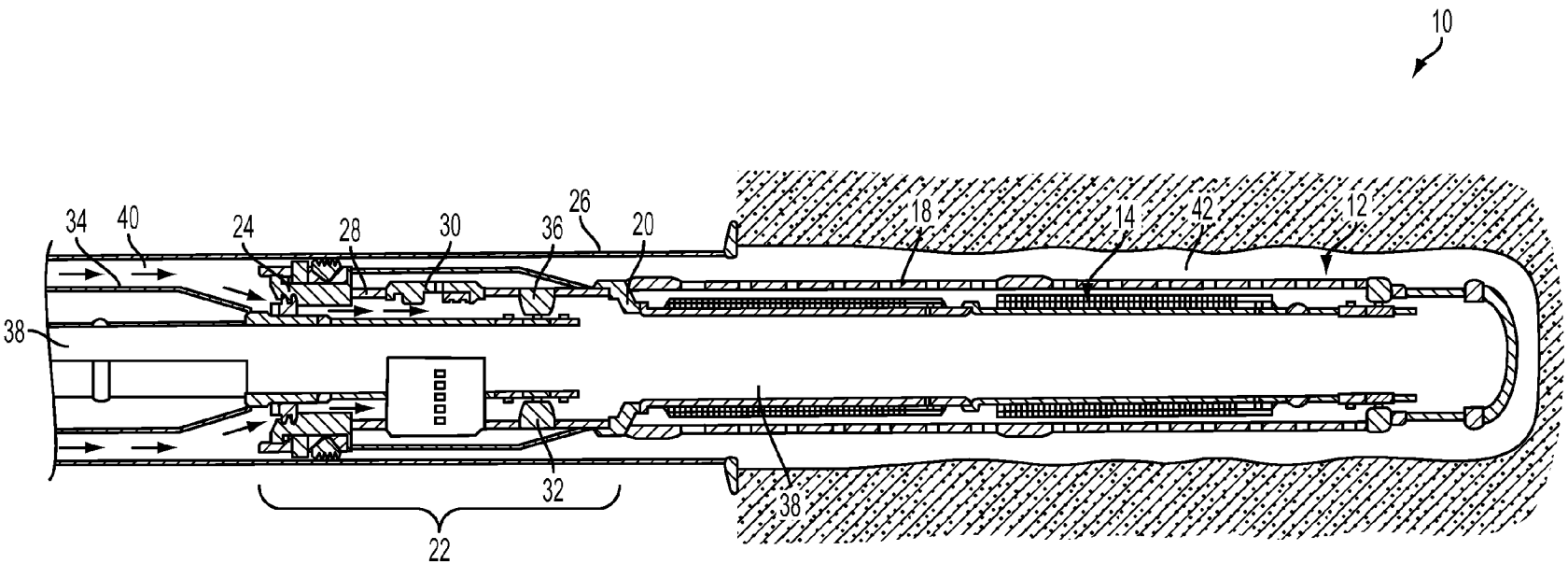
FIG. 4 is a schematic view of the system of FIG. 1 illustrating closure of a remotely closable valve.

In FIG. 3 it will be appreciated that flow of fluid is opposite that illustrated in FIG. 2. In one embodiment, it is this flow direction coupled with a threshold flow velocity that causes the valve 30 to close. In such an embodiment, one valve that operates effectively for the purpose is the ICS Defender valve from Baker Oil Tools noted above. In other embodiments however, it is to be appreciated that ultimately the requirement is that the flow path through the valve 30 be terminated after the warm-up phase is concluded. This can be accomplished with an intervention tool if necessary. Graphic illustration of the effect of closure of the valve is provided in FIG. 4.

As noted above, FIGS. 1-4 are representative of both injector and producer wells in the system disclosed herein. At this point in the operation of the wells, the actions of the injector well(s) and the producer well(s) diverge.

Figure 5:
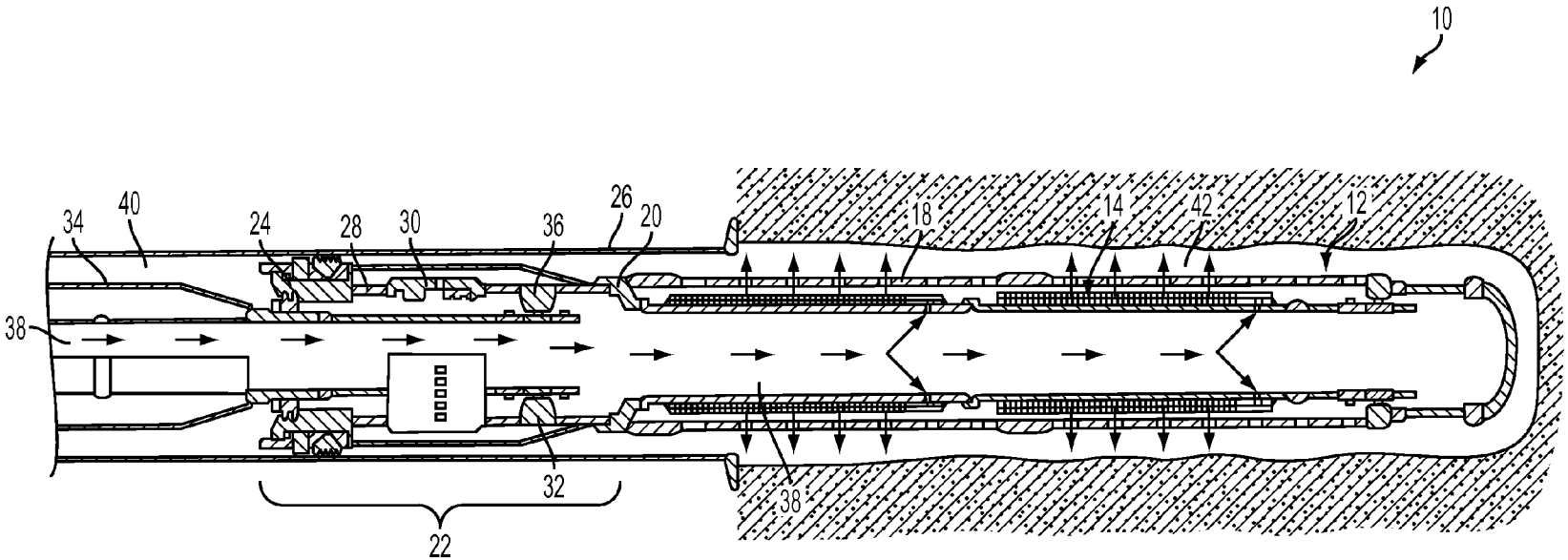
FIG. 5 is a schematic view of the system of FIG. 1 illustrating a steam injection by the injector well.

Referring to FIG. 5, an illustration of fluid flow in the injector well(s) is provided. Arrows indicate the direction of fluid flow, which at this point is generally steam, into the formation. Since the valve 30 is at this point closed, there is no escape route for the steam other than into the formation. Pumping from surface causes a condition known as a "squeeze" to force the steam into the formation. Equalizer(s) 14 will ensure an even distribution of the steam into the formation. The steam heats the formation to reduce viscosity of the target hydrocarbon fluid to facilitate gravity drainage of the same. The draining fluid flows to the producer well(s) for production.

Figure 6:
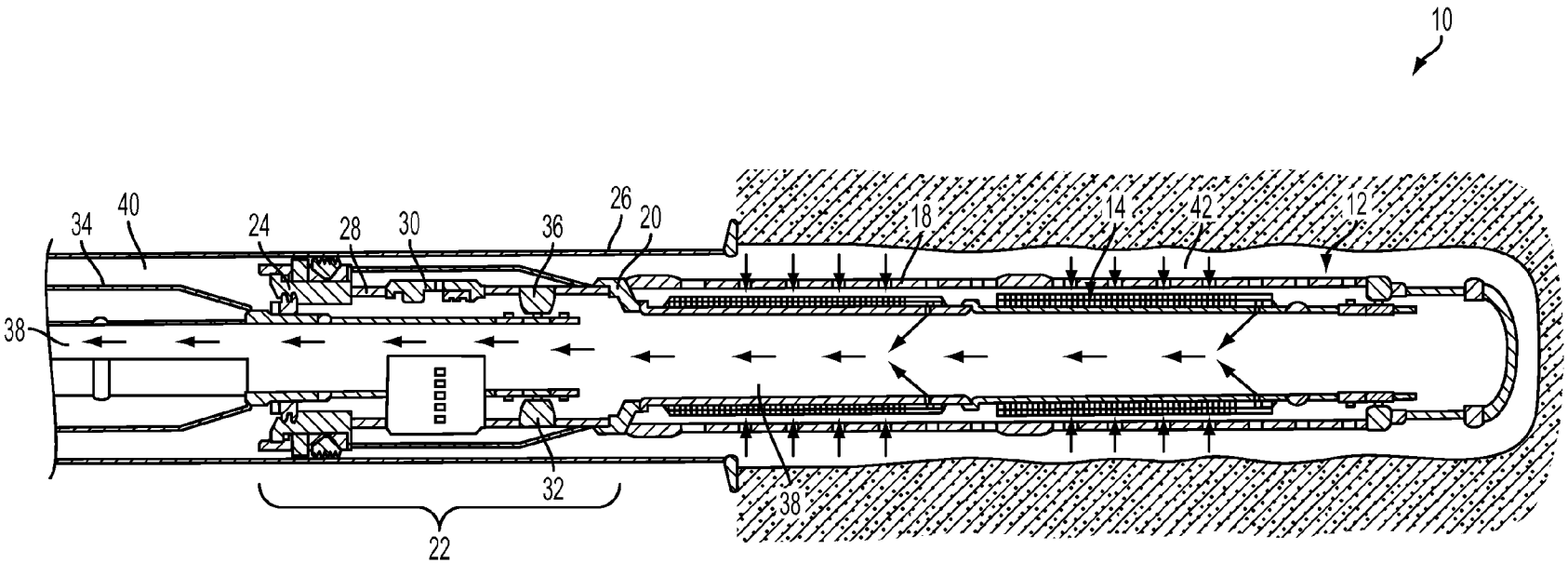
FIG. 6 is a schematic view of the system of FIG. 1 illustrating a hydrocarbon flow into the well in the producer well.

Referring to FIG. 6, a producer well is illustrated with arrows showing target hydrocarbon fluid evenly flowing into the system through the equalizer(s) 14 to the axial flow channel 38 and uphole.

The portion of the system just described avoids the need for nested tubulars while preserving and enhancing the functionality of a SAGD system.

Figure 7:
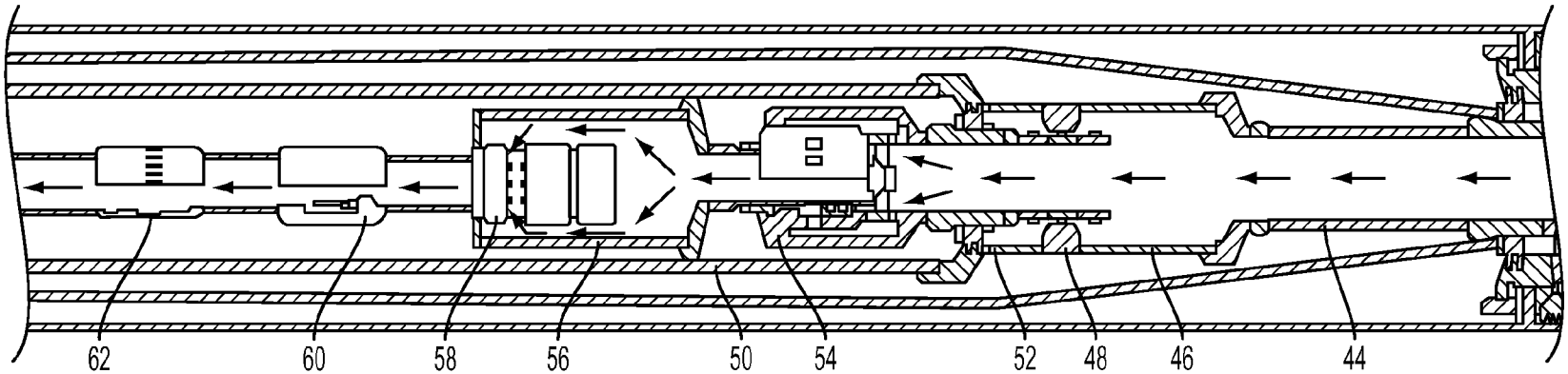
FIG. 7 is a schematic view of a production string stabbed into the BHA illustrated in FIG. 1 and showing hydrocarbon fluid flow therethrough in a production mode.
Figure 8:
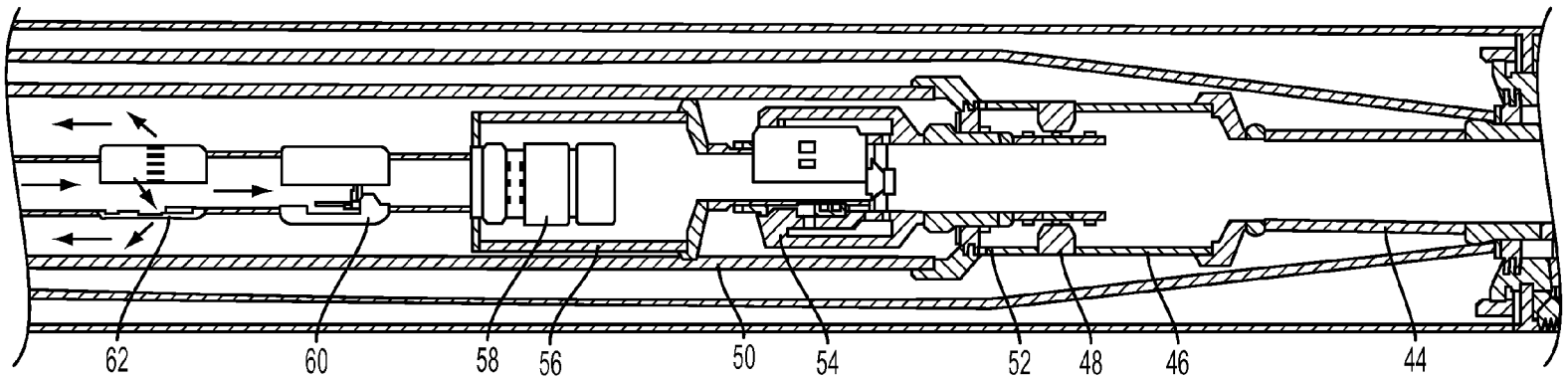
FIG. 8 is a schematic view of a production string stabbed into the BHA illustrated in FIG. 1 and showing a cooling cycle for the upper string including an Electric submersible pump (ESP).

Referring now to FIGS. 7 and 8, a portion of the system disclosed herein, that portion being associated only with the producer well(s), is illustrated. At a downhole end of the drawing, the packer 24 described above can be seen. This will provide continuity with the above discussed figures. Uphole string 34 includes one or more space out subs 44 (one shown) and a seal bore sub 46 attached thereto. The seal bore sub 46 includes a seal bore 48 and is connected at its uphole end to a tubular 50, also a part of uphole string 34. Within the tubular 50 and stabbed into the seal bore 48 is an inner string 52 sealingly engaged with the seal bore 48 in uphole string 34. Inner string 52 includes a reservoir control valve 54 that is closeable and openable automatically based upon withdrawal of the rest of the inner string 52, which is pulled in the event that an electric submersible pump (ESP) requires maintenance or replacement. Returning to the inner string 52 components, an ESP housing 56, which houses an ESP 58, is connected to a backflow valve 60 such as a flapper valve and a radial flow valve 62 such as a sliding sleeve. This configuration of components allows for one important benefit of the presently disclosed system in that the ESP 58, along with the majority of the inner string 52 (everything but the reservoir control valve 54), can be pulled from the well without affecting the completion below the packer 24 and without disturbing any control lines. This feature of the invention is enabled by the uphole string 34 configuration and support of the control lines by tubular 50 and the packer 24. Each of the packer 24 and the tubular 50 are configured with the capability of feeding through control lines so that they are not impacted by a removal of the inner string 52. Withdrawal of the ESP and inner string 52, therefore, does not affect control lines that monitor or control wellbore operations downhole of the ESP, in an embodiment that uses such control lines. This means that the most heated portion of the system does not have to be cooled, and the heat in the formation is not lost. Further, because of the valve 54, the well is shut in upon pulling the uphole string 34. In practice, the backflow valve 60 is triggered by a reversal of flow direction, i.e., flow is downhole axially through the uphole string 34. This both causes the valve 62 to open and subsequent to closing causes pressure to rise in the uphole string 34, which causes the valve 62 to open. Reverse circulation can then be initiated to cool the uphole string 34 for retrieval to the surface while having a minimal affect on the temperature of the formation and lower completion. FIG. 8 illustrates the cooling reverse flow on the uphole string 34. Removal of the ESP for any reason is thus facilitated where in prior systems, a significant burden would be encountered if the ESP required maintenance.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A system comprising:

a string defining an axial flow channel and an annular flow pathway, the annular flow pathway comprising an uphole annular flow pathway and a downhole annular flow pathway, the axial flow channel extending continuously through and between the uphole and downhole annular flow pathways, the string selected from at least one of a steam injection string and a production string of a steam assisted gravity drainage (SAGD) system, the string including an uphole segment and a downhole segment, the uphole segment insertable into the downhole segment, the downhole segment including tubing, and an inside surface of the tubing and an outer surface of the uphole segment defining a portion of the uphole annular flow pathway;

a fluid access structure between the axial flow channel and the annular flow pathway;

a valve disposed within the annular flow pathway, the valve being selectively closable to selectively inhibit annular flow between the uphole and downhole annular flow channels, the string and valve configured such that a fluid flows in a first direction in the axial flow channel and in a second direction opposite the first direction in the uphole and downhole annular flow pathways when the valve is in an open position, the valve configured to slide along the tubing of the downhole segment to selectively expose an opening in the tubing in an open position and block the opening in the tubing in a closed position.

2. The system as claimed in claim 1 wherein, the fluid access structure is an equalizer.

3. The system as claimed in claim 1 wherein, the fluid access structure is a series of equalizers.

4. The system as claimed in claim 1 wherein, the valve is a flow actuated valve.

5. The system as claimed in claim 4 wherein, the flow is a reverse flow.

6. The system as claimed in claim 4 wherein, the fluid access structure is disposed radially inwardly of a fluid permeable shroud.

7. The system as claimed in claim 1, wherein the valve is configured to close in response to an annular downhole flow of fluid having a threshold fluid velocity.

8. The system of claim 1, wherein the axial channel and the valve are configured to permit a fluid flow continuously through the axial channel, including through a portion of the axial channel located radially inward from the valve, when the valve is in the closed position.

9. The system of claim 1, wherein the valve is configured to close based on a flow of a predetermined velocity through the upper annular flow pathway.

10. The system of claim 1, wherein the valve defines an opening connecting the uphole annular flow pathway to the downhole annular flow pathway.

11. The system of claim 1, wherein the fluid access structure includes openings to permit fluid flow radially between the annular flow pathway and the axial flow channel.

12. A completion comprising:

a borehole string selected from at least one of a steam injection string and a production string of a steam assisted gravity drainage (SAGD) system, the borehole string defining an axial channel and an annular flow pathway, the borehole string including an uphole segment and a downhole segment, the uphole segment insertable into the downhole segment, the downhole segment including tubing, and an inside surface of the tubing and an outer surface of the uphole segment defining a portion of the annular flow pathway;

a plurality of equalizers disposed at the borehole string and defining a predominantly axial flow;

a shroud radially outwardly adjacent the equalizers;

a selectively closeable valve positioned in the annular flow pathway to selectively inhibit annular flow between an uphole portion of the annular flow pathway and a downhole portion of the annular flow pathway from a point proximate an uphole extent of the plurality of equalizers, the axial channel extending continuously through and between the uphole portion and the downhole portion of the annular flow pathway, such that a fluid flows in a first direction in the axial flow channel and in a second direction opposite the first direction in the uphole and downhole portions of the annular flow pathway when the valve is in an open position, the valve configured to slide along the tubing of the downhole segment to selectively expose an opening in the tubing in an open position and block the opening in the tubing in a closed position.

13. The completion of claim 12, wherein the axial channel and the valve are configured to permit a fluid flow continuously through the axial channel, including through a portion of the axial channel located radially inward from the valve, when the valve is in the closed position.

14. The completion of claim 12, wherein the valve is configured to close based on a flow of a predetermined velocity through the upper portion of the annular flow pathway.

15. The completion of claim 12, wherein the valve defines an opening connecting the uphole portion of the annular flow pathway to the downhole portion of the annular flow pathway.

16. A system comprising:

a string defining an axial flow channel and an annular flow pathway, the annular flow pathway comprising an uphole annular flow pathway and a downhole annular flow pathway, the axial flow channel extending continuously through and between the uphole and downhole annular flow pathways, the string selected from at least one of a steam injection string and a production string of a steam assisted gravity drainage (SAGD) system;

a fluid access structure between the axial flow channel and the annular flow pathway;

a valve disposed within the annular flow pathway, the valve being selectively closable to selectively inhibit annular flow between the uphole and downhole annular flow channels, the string and valve configured such that a fluid flows in a first direction in the axial flow channel and in a second direction opposite the first direction in the uphole and downhole annular flow pathways when the valve is in an open position, wherein the string comprises an uphole string and an inner string, the inner string including one or more components being sealed to the uphole string through a reservoir control valve, the reservoir control valve being automatically closed upon retrieval of the one or more components of the inner string and automatically openable upon replacement of the one or more components of the inner string.

17. The system as claimed in claim 16 wherein the one or more components of the inner string includes an ESP.

18. The system as claimed in claim 16 wherein the reservoir control valve shuts in the well when the one or more components of the inner string is retrieved.

19. The system as claimed in claim 16 wherein the inner string includes a radial flow valve to facilitate circulation at the inner string to cool the inner string.

20. The system as claimed in claim 19 wherein the radial flow valve is a sliding sleeve that is openable responsive to a pressure threshold.

* * * * *